US007789490B2

(12) United States Patent
Saito et al.

(10) Patent No.: US 7,789,490 B2
(45) Date of Patent: Sep. 7, 2010

(54) LIQUID DISCHARGE HEAD AND METHOD OF MANUFACTURING THE SAME

(75) Inventors: Yoshikazu Saito, Kawasaki (JP); Norio Ohkuma, Machida (JP); Etsuko Hino, Tokyo (JP); Mitsutoshi Noguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 599 days.

(21) Appl. No.: 11/775,994

(22) Filed: Jul. 11, 2007

(65) Prior Publication Data

US 2008/0018712 A1 Jan. 24, 2008

(30) Foreign Application Priority Data

Jul. 18, 2006 (JP) ..... 2006-195145

(51) Int. Cl.
*B41J 2/05* (2006.01)

(52) U.S. Cl. ..... 347/65

(58) Field of Classification Search ..... 347/54, 347/56, 61–65, 67, 70, 47, 44–45, 20; 29/25.35, 29/890.1

See application file for complete search history.

(56) References Cited

U.S. PATENT DOCUMENTS

| | | | | |
|---|---|---|---|---|
| 4,450,455 | A | 5/1984 | Sugitani et al. | 347/45 |
| 4,558,333 | A | 12/1985 | Sugitani et al. | 347/65 |
| 5,510,818 | A | 4/1996 | Shimomura et al. | 347/65 |
| 5,730,889 | A | 3/1998 | Miyagawa et al. | |
| 6,455,112 | B1 | 9/2002 | Ohkuma et al. | |
| 6,719,404 | B2 * | 4/2004 | Kobayashi | 347/54 |
| 6,786,576 | B2 * | 9/2004 | Mitani | 347/63 |
| 7,416,285 | B2 * | 8/2008 | Kato et al. | 347/56 |
| 2006/0132539 | A1 | 6/2006 | Hino et al. | |
| 2006/0277755 | A1 | 12/2006 | Kubota et al. | |
| 2007/0085877 | A1 | 4/2007 | Ohkuma et al. | |
| 2007/0099121 | A1 | 5/2007 | Kubota et al. | |

* cited by examiner

*Primary Examiner*—K. Feggins
(74) *Attorney, Agent, or Firm*—Fitzpatrick, Cella, Harper & Scinto

(57) ABSTRACT

An ink jet recording head can record an image having a high quality level for a long period of time by use of a material having a reduced linear expansion coefficient and a satisfactory patterning characteristic. The liquid discharge head includes an energy generating element which generates energy for discharging a liquid; a discharge port which discharges the liquid; and a flow path forming member to form a flow path which supplies the liquid to the discharge port, the flow path forming member being formed of a cured material of a resin composition including a cationic polymerizable resin, a cationic photopolymerization initiator, a condensation product of hydrolyzable organic silane compounds, and inorganic fine particles having an average particle diameter of 50 nm or less.

7 Claims, 3 Drawing Sheets

LIQUID DISCHARGE HEAD AND METHOD OF MANUFACTURING THE SAME

BACKGROUND OF THE INVENTION

1. Field of the Invention

The present invention relates to a liquid discharge head which discharges a liquid and a method of manufacturing the liquid discharge head. The present invention more particularly relates to an ink jet recording head which discharges ink to a recording medium to record an image on the medium and a method of manufacturing the ink jet recording head.

2. Description of the Related Art

Examples of use of a liquid discharge head which discharges a liquid includes an ink jet recording system which discharges ink to a recording medium to record an image on the medium.

The ink jet recording head applied to the ink jet recording system generally includes a plurality of fine ink discharge ports, a plurality of ink flow paths and a plurality of energy generating elements disposed at a part of the ink flow paths. A technology to highly precisely prepare micro structures such as the ink flow paths and discharge ports is required. As such a technology, photolithography is an excellent technology in respect of both of precision and simplicity of steps.

Heretofore, as a method of preparing the ink jet recording head, a method is disclosed in, for example, U.S. Pat. No. 4,450,455, in which an ink flow path pattern is made of a photosensitive resin on a substrate provided with the energy generating elements, a top plate of glass or the like is bonded to the substrate, and then an end surface of the resultant bonded material is mechanically cut to form the discharge ports, thereby preparing the ink jet recording head.

Moreover, in U.S. Pat. No. 4,558,333, a method is disclosed in which the ink flow path and the ink discharge ports are formed of a first photosensitive resin on the substrate provided with the energy generating elements to prepare the ink jet recording head.

On the other hand, since enlargement of the recording head itself and extension of a printing width very effectively achieve increase of a recording speed, investigations of the enlargement and the extension are advanced with respect to the head of each system. On the other hand, an inorganic substance made of silicon or the like is frequently used in the above-mentioned substrate. However, during the preparation of the ink jet recording head, a heating treatment is performed in many cases. Therefore, when a thickness and an area of an ink flow path member increase, warpage and peel are sometimes generated among photosensitive resin layers constituting ink flow path walls and the substrate and the top plate owing to differences of linear expansion coefficients.

In general, the resin material has a linear expansion coefficient larger than that of a material such as silicon for use in the substrate. Therefore, as a method of reducing the linear expansion coefficient of the resin, in general, a method is generally adopted in which the resin is filled with a filler such as amorphous silica. In U.S. Pat. No. 5,510,818, a method of manufacturing the ink jet recording head is disclosed in which an epoxy resin filled with an inorganic filler to reduce the linear expansion coefficient of the resin is used in the ink flow path walls.

However, an average particle diameter of inorganic particles for use as the filler is usually about several tens of μms to several μms. When the photosensitive resin is filled with the filler and exposed, a ray for use in the exposure is absorbed, reflected or scattered, sensitivity of the photosensitive resin is reduced, and resolution also remarkably deteriorates.

On the other hand, when the average particle diameter of the inorganic particles is several hundreds of nanometers to several tens of nanometers, it is considered that the filler is sufficiently transparent to the ray for use in the exposure. However, when the particle diameters of such so-called inorganic fine particles decrease, forces applied between the particles increase, and the particles easily aggregate. Therefore, it is remarkably difficult to singly scatter the inorganic fine particles having particle diameters of the order of nanometers by mechanical kneading. Therefore, even when the average particle diameter is several hundreds of nanometers to several tens of nanometers or less, transparency to the ray for use in the exposure cannot be obtained in some case. Therefore, difficulty remains in fine processing in which the photolithographic technology is used.

SUMMARY OF THE INVENTION

The present invention has been developed in view of the above miscellaneous respects, and an object thereof is to provide an ink jet recording head in which an image having a high quality level can be recorded for a long period of time by use of a material having a reduced linear expansion coefficient and a satisfactory patterning characteristic.

The present invention is a liquid discharge head comprising: an energy generating element which generates energy for discharging a liquid; a discharge port which discharges the liquid; and a flow path which supplies the liquid to the discharge port, and characterized in that a flow path forming member which forms the flow path is made of a cured material of a resin composition including a cationic polymerizable resin, a cationic photopolymerization initiator, a condensation product of hydrolyzable organic silane compounds and inorganic fine particles having an average particle diameter of 50 nm or less.

Moreover, the present invention is a method of manufacturing a liquid discharge head including energy generating elements which generate energy utilized to discharge a liquid, discharge ports which discharge the liquid, and flow paths which supply the liquid to the discharge ports, characterized by comprising: forming, on a substrate, a first photosensitive resin layer including a cationic polymerizable resin, a cationic photopolymerization initiator, a condensation product of hydrolyzable organic silane compounds and inorganic fine particles having an average particle diameter of 50 nm or less; patterning the photosensitive resin layer to form a first flow path forming member which forms the flow paths; forming a sacrifice layer made of a soluble resin on the substrate so as to cover the first flow path forming member; polishing the sacrifice layer and the flow path forming member toward the substrate from a side of the substrate provided with the sacrifice layer to set a height of the flow path forming member from the substrate to be equal to that of the sacrifice layer from the substrate; forming a second photosensitive resin layer on the sacrifice layer and the flow path forming member; patterning the second photosensitive resin layer to form the discharge ports in the second photosensitive resin layer; and removing the sacrifice layer to form the flow paths.

According to the present invention, in the ink jet recording head, a difference of a linear expansion coefficient between the flow path forming member and the substrate can be reduced. Moreover, highly precise patterning can be performed, and ink flow path walls having excellent shape stability, stability with elapse of time and durability can be formed. Therefore, a highly reliable ink jet recording head can be obtained which is capable of forming an image having a high quality level over a long period of time.

Further features of the present invention will become apparent from the following description of exemplary embodiments with reference to the attached drawings.

DESCRIPTION OF THE EMBODIMENTS

Figure 1:
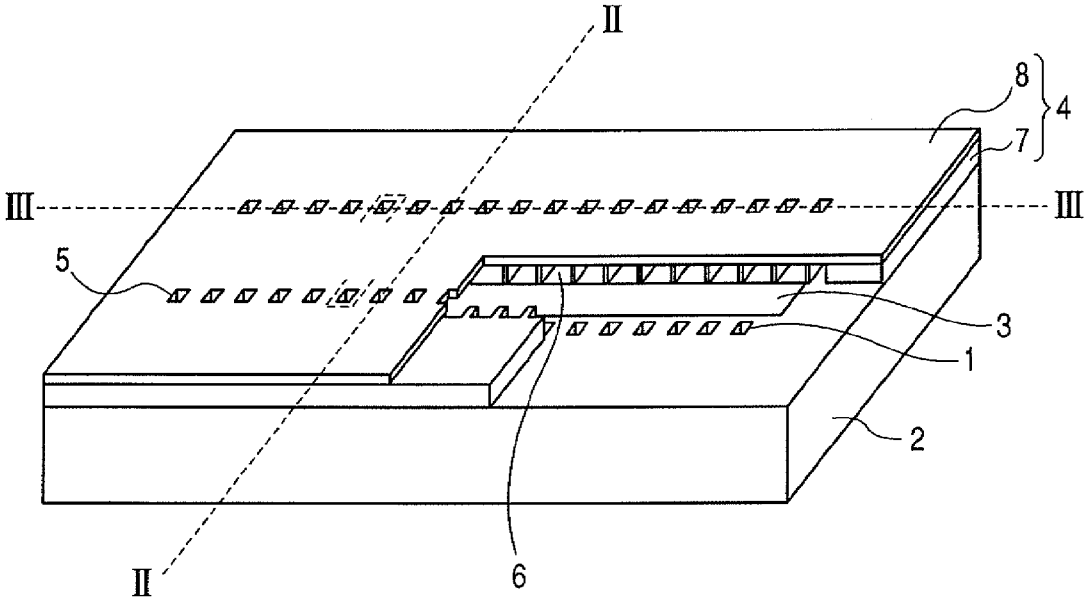
FIG. 1 is a schematic perspective view illustrating one example of an ink jet recording head according to the present invention.

As a result of intensive investigations, the present inventors have found that, when the photosensitive resin is blended with a hydrolyzable organic silane compound and inorganic fine particles to prepare a resin composition, the resin composition having a satisfactory patterning characteristic is obtained in which inorganic fine particles do not aggregate and are uniformly scattered. It has also been found that, when the resin composition obtained in this manner is applied to a liquid discharge head, a flow path forming member having a small difference from a substrate in a linear expansion coefficient and having a fine shape is obtained.

An embodiment of the present invention will hereinafter be described with reference to the drawings. It is to be noted that, in the following description, constitutions having the same function are denoted with the same reference numerals, and description thereof is omitted.

In the present invention, as an application example of the present invention, an ink jet recording system will be described, but an application range of the present invention is not limited to this example, and the present invention is applicable to a liquid discharge head and the like for applications such as preparation of a bio chip and printing of an electronic circuit.

First, an ink jet recording head to which the present invention is applicable will be described.

FIG. 1 is a schematic diagram illustrating the ink jet recording head according to one embodiment of the present invention.

The ink jet recording head of the present embodiment has a substrate 2 made of Si and provided with heating resistance materials as energy generating elements 1 which are arranged at a predetermined pitch in two rows. In the substrate 2, a supply opening 3 formed by anisotropically etching Si is opened between the two rows of energy generating elements. On the substrate 2, discharge ports 5 opened above the energy generating elements 1 and individual flow paths 6 of ink which communicate with the discharge ports 5 via the ink supply opening 3 are formed with a flow path forming member 4 patterned by a technology of photolithography. Here, the ink jet recording head shown in this drawing includes the flow path forming member formed of a first flow path forming member 7 and a second flow path forming member 8, and the second flow path forming member 8 is provided with the discharge ports 5. Moreover, the second flow path forming member 8 is bonded to the substrate 2 via the first flow path forming member 7. Here, the flow path forming member 4 may be formed of two members of the first and second flow path forming members as described above, and may integrally be formed. In the shown ink jet recording head, the energy generating elements 1 are positioned so as to face the discharge ports 5, but the present invention is not limited to this embodiment. For example, the discharge ports 5 may be formed in a horizontal direction with respect to a plane provided with the energy generating elements 1.

To form the substrate 2, a semiconductor manufacturing technology is applicable to the forming of the energy generating elements 1, a circuit which drives the elements, wiring lines which supply power to the elements and the like, and highly precise processing can be performed. Therefore, Si can be used in the substrate as described above. However, a material of the substrate is not limited to Si, and another material may be used as long as the material has the above-mentioned processing characteristics.

The flow path forming member 4 of the present invention is formed of at least a cured material of a resin composition (referred to as the resin composition (1) in the following description) including the following: (a) a cationic polymerizable resin; (b) a cationic photopolymerization initiator; (c) a condensation product of hydrolyzable organic silane compounds; and (d) inorganic fine particles having an average particle diameter of 50 nm or less.

The cationic polymerizable resin (a) is a resin having a cationic polymerization group such as a vinyl group or a cyclic ether group. Above all, a compound having an epoxy group, an oxetane group and a vinyl ether group can be used. Specific examples of the epoxy resin include the following: bisphenol type epoxy resins such as bisphenol-A-diglycidyl ether and bisphenol-F-diglycidyl ether including a monomer or an olygomer having a bisphenol skeleton; a phenol novolak type epoxy resin; a cresol novolak type epoxy resin; a trisphenol methane type epoxy resin; and a resin such as 3,4-epoxycyclohexenyl methyl-3',4'-epoxycyclohexene carboxylate having an alicyclic structure.

Alternatively, a multifunctional epoxy resin including a portion having an epoxy group at a side chain of an alicyclic skeleton represented by the following formula (1) can be used.

(Formula 1)

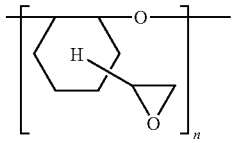

(n is an integer.)

Alternatively, a bisphenol type epoxy resin represented by the following formula (2) can be used.

(Formula 2)

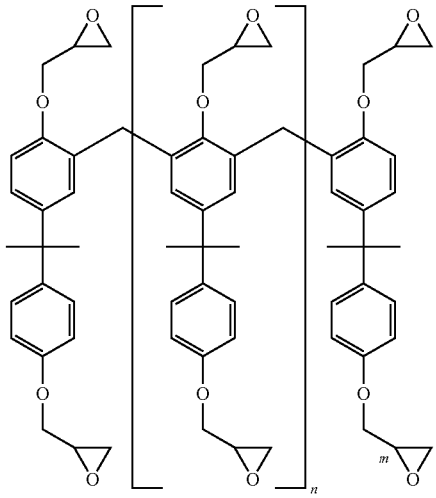

(m is an integer.)

To obtain a satisfactory patterning characteristic, these cationic polymerizable resins can have a solid state at room temperature, or have a melting point of 40° C. or more in a stage before polymerization. The compound having an epoxy equivalent weight (or an oxetane equivalent weight) of 2000 or less, more preferably 1000 or less can be used. When the epoxy equivalent weight exceeds 2000, a crosslinking density during a curing reaction decreases, Tg or thermal deformation temperature of a cured material drops, or a problem is sometimes generated in a close contact property with respect to the substrate and resistance to the ink.

Moreover, examples of the resin containing the oxetane compound include resins including a phenol novolak type oxetane compound and a cresol novolak type oxetane compound. The examples also include resins including a trisphenol methane type oxetane compound, a bisphenol type oxetane compound and a biphenol type oxetane compound.

When the resin including these oxetane compounds is used together with the above-mentioned epoxy resin, the curing reaction can be promoted in some case.

Examples of the cationic photopolymerization initiator (b) include one selected from one of onium salts, borates, compounds having an imide structure, compounds having a triazine structure, azo compounds, and peroxides. Examples of the initiator on the market include SP-150, SP-170 and SP-172 manufactured by Asahi Denka Kogyo K.K. and Rhodorsil 2074 manufactured by Rhodia Co. Above all, aromatic sulfonium salt and aromatic iodonium salt can be used in respect of sensitivity, stability and reactivity. It is useful to use various sensitizers for improvement of the sensitivity and adjustment of a photosensitive wavelength.

Examples of condensation product of the hydrolyzable organic silane compound (c) include a condensation product obtained by hydrolyzing a compound represented by the following formula (3).

$$(R^4)_r—Si—(OR^2)_s \qquad \text{Formula (3),}$$

in which r+s=4 (r=one of 0, 1, 2 and 3, s=one of 1, 2, 3 and 4), $R_2$ is a saturated or unsaturated hydrocarbon residue and $R_4$ is an alkyl or aryl substituent or non-substituent. As a hydrolyzable organic silane compound, specific examples of the compound include the following compounds, but the present invention is not limited to the compounds: Tetramethoxysilane, tetraethoxysilane, tetrapropoxysilane, methyl trimethoxysilane, methyl triethoxysilane, methyl tripropoxysilane, ethyl trimethoxysilane, ethyl triethoxysilane, ethyl tripropoxysilane, propyl trimethoxysilane, propyl triethoxysilane, propyl tripropoxysilane, phenyl trimethoxysilane, phenyl triethoxysilane, phenyl tripropoxysilane, diphenyl dimethoxysilane, diphenyl diethoxysilane, glycidoxypropyl trimethoxysilane, glycidoxypropyl triethoxysilane, glycidoxypropyl methyldimethoxysilane, glycidoxypropyl methyldiethoxysilane, glycidoxypropyl dimethyl methoxysilane, glycidoxypropyl dimethyl ethoxysilane, 2-(epoxycyclohexyl)ethyltrimethoxysilane and 2-(epoxycyclohexyl)ethyltriethoxysilane.

Examples of the inorganic fine particles (d) include a single metal, inorganic oxide, inorganic carbonate, inorganic sulfate, phosphate, carbon and pigment. Examples of the single metal include gold, silver, platinum and aluminum. Examples of inorganic oxide include silica (colloidal silica, aerosil, glass, etc.), alumina, titania, zirconia and zinc oxide. The examples of inorganic oxide also include barium titanate, zirconium titanate, lead titanate, lithium niobate, copper oxide, lead oxide, yttrium oxide, tin oxide and magnesium oxide. Examples of inorganic carbonate include calcium carbonate and magnesium carbonate. Examples of sulfate include barium sulfate and calcium sulfate. Examples of phosphate include calcium phosphate and magnesium phosphate.

A shape of the inorganic fine particles is not limited to a spherical shape, and the particles may have an elliptic, flat, rod-like or fibrous shape. An average primary particle diameter of the fine particles may be set to be smaller than an exposure wavelength and selected so that the exposure wavelength is less absorbed, and the diameter can be set to 50 nm or less. Specific examples of the particles on the market which satisfy these conditions include the following: Silica sols "Methanol Silica Sol", "IPA-ST", "IPA-ST-UP", "EG-ST", "NPC-ST-30", "DMAC-ST", "MEK-ST", "MIBK-ST", "XBA-ST" and "PMA-ST" manufactured by Nissan Chemical Industries, Ltd., silica sols "PL-1", "PL-2" and "PL-3" manufactured by FUSO Chemical Co., Ltd., silica sols "OSCAL series" manufactured by NIPPON SHOKUBAI Co., Ltd. and alumina sols "Alumina Sol-10" and "Alumina Sol-10D" manufactured by Kawaken Fine Chemicals Co., Ltd.

These inorganic fine particles may be used alone or as a mixture of two or more of them.

A content of the inorganic fine particles in the photosensitive resin composition can be set to 10 wt % to 90 wt % in terms of a solid content with respect to a sum of the above components (a) to (d). This is because, if the content of the inorganic fine particles is 10 wt % or less, a desired performance cannot be exerted. If the content of the inorganic fine particles is 90 wt % or more, a patterning characteristic of the resin composition might be deteriorated. The content can further be set to 20 wt % to 80 wt %.

The inorganic fine particles may be subjected to a physical surface treatment such as a plasma discharge treatment or a corona discharge treatment for purposes of improvement of dispersion stability in a dispersion liquid or a coating liquid and improvement of affinity and a bonding property with respect to the cationic polymerizable resin (a). For similar purposes, the particles may be subjected to a chemical surface treatment with various surfactants, the hydrolyzable organic silane compound and the like. Especially, as the above-mentioned surface treatment agent, the hydrolyzable organic silane compound (c) or a partial condensate of the compound can be used.

As a method of preparing the resin composition having the above (a) to (d), the following method can be used. That is, a method can be used in which the hydrolyzable organic silane compound (c) and the inorganic fine particles (d) are mixed in a solvent, the inorganic fine particles are uniformly dispersed while the hydrolyzable organic silane compound is condensed. And then the cationic polymerizable resin (a) and the cationic photopolymerization initiator (b) are further mixed in another solvent. In this manner, a resin composition in which the inorganic fine particles (d) are evenly dispersed can be obtained. Details of this method will be described later.

Moreover, an additive or the like may appropriately be added to the photosensitive resin composition. For example, a silane coupling agent or the like may be added for a purpose of improvement of a close contact force with respect to the substrate.

Furthermore, to dispose the second flow path forming member 8, a metal plate of eletrocast nickel, SUS, aluminum or the like, or an organic material such as polyimide, polyether sulfone or polyphenylene sulfide can be used. A member formed by making holes in a ceramic such as alumina or barium titanate, or a member formed by making the discharge ports in a photosensitive resin dry film or the like by photolithography can be used. The discharge ports 5 may be formed after or before the material is bonded to the flow path forming member.

This ink jet recording head is disposed so that the surface provided with the ink supply opening 3 faces a recording surface of a recording medium. Moreover, this ink jet recording head applies a pressure generated by the energy generating elements 1 to ink with which the ink flow paths are filled via the ink supply opening 3 to discharge liquid droplets from the discharge ports 5, and attaches the droplets to the recording medium to record an image on the medium.

This ink jet recording head can be mounted on a printer, a photocopier, a facsimile machine, a device such as a word processor having a printer section and an industrial recording device to be combined with various processing devices in a complex manner.

Next, one example of a method of manufacturing the ink jet recording head of the present invention will be described with reference to FIGS. 2A to 2F.

FIGS. 2A to 2F are schematic sectional views of the ink jet recording head cut along the line II-II of FIG. 1 as viewed at a position of a section vertical to the surface of the substrate 2.

Figure 2A:
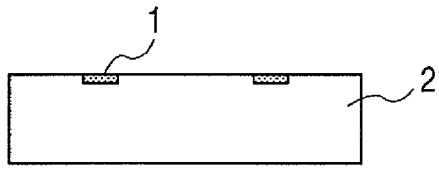
FIGS. 2A, 2B, 2C, 2D, 2E and 2F are schematic sectional views illustrating one example of a method of manufacturing the ink jet recording head of the present invention.

First, as shown in FIG. 2A, the substrate 2 of silicon provided with the energy generating elements 1 for generating energy to discharge the ink is prepared.

Figure 2B:
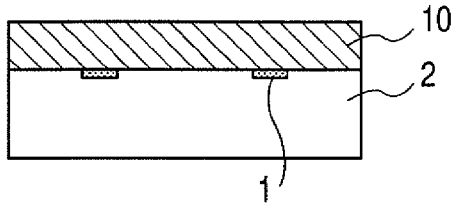

Subsequently, as shown in FIG. 2B, the resin composition (1) of the present invention is formed, on the substrate, as a negatively photosensitive resin layer 10 having a portion cured when irradiated with light. Examples of a method of forming the photosensitive resin layer 10 include a spin coating process.

Figure 2C:
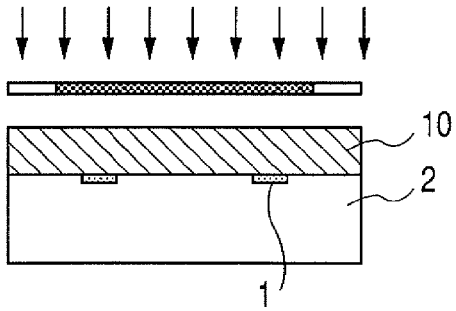

Subsequently, as shown in FIG. 2C, a portion of the photosensitive resin layer 10 which forms the flow path forming member 7 is exposed through a mask. A wavelength for use in the exposure may appropriately be selected.

Figure 2D:
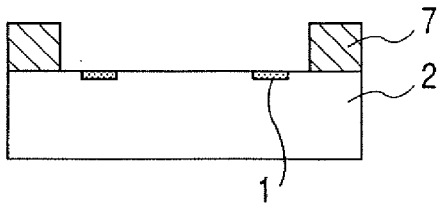

Subsequently, the photosensitive resin layer 10 is subjected to development to form the first flow path forming member 7 as shown in FIG. 2D. A suitable developer liquid can appropriately be selected for the development.

Figure 2E:
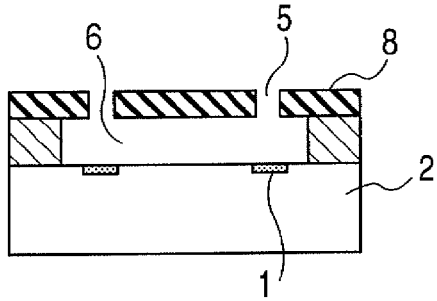

Subsequently, as shown in FIG. 2E, the second flow path forming member 8 provided with the discharge ports 5 is bonded to the first flow path forming member 7. In this case, a material or a bonding method of the first flow path forming member 7 is selectable from the above-mentioned material and method, if necessary.

Figure 2F:
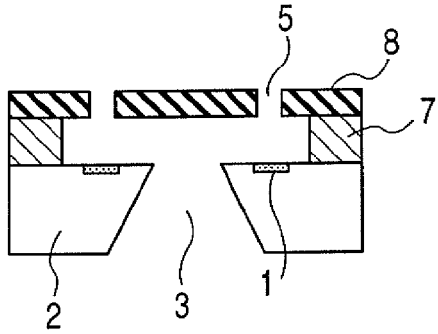

Finally, as shown in FIG. 2F, the ink supply opening 3 is formed to complete the ink jet recording head. As a method of forming the ink supply opening 3, a method such as anisotropic etching can be adopted.

Moreover, an especially suitable example of the method of manufacturing the ink jet recording head of the present invention will be described with reference to FIGS. 3A to 3H.

FIGS. 3A to 3H illustrate schematic sectional views of the ink jet recording head cut along the line III-III of FIG. 1 as viewed at a position of a section vertical to the surface of the substrate.

Figure 3A:
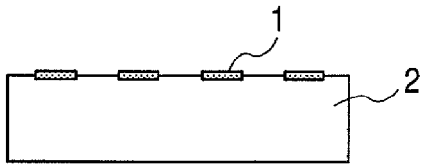
FIGS. 3A, 3B, 3C, 3D, 3E, 3F, 3G and 3H are schematic sectional views illustrating one example of a method of manufacturing the ink jet recording head of the present invention.

First, as shown in FIG. 3A, the substrate 2 of silicon provided with the energy generating elements 1 for generating the energy to discharge the ink is prepared.

Figure 3B:
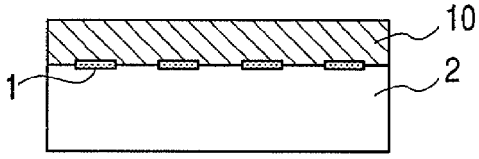

Subsequently, as shown in FIG. 3B, the first photosensitive resin layer 10 including the resin composition (1) is formed on the substrate 2. Examples of a method of forming the layer include a spin coating process.

Figure 3C:
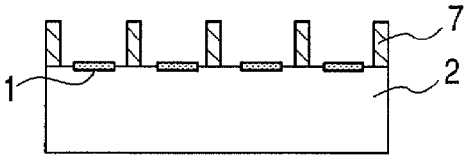

Subsequently, as shown in FIG. 3C, a portion of the first photosensitive resin layer 10 which forms the flow path forming member is exposed through a mask. A wavelength during the exposure may appropriately be selected. Subsequently, the first photosensitive resin layer 10 is subjected to development to form the first flow path forming member 7. A suitable developer liquid can appropriately be selected for the development.

Figure 3D:
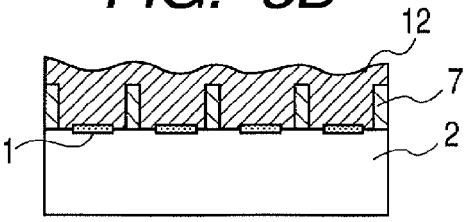

Subsequently, as shown in FIG. 3D, a sacrifice layer is formed on the first flow path forming member 7 so as to cover the member. Any material that forms a sacrifice layer 12 may be selected as long as the material can be removed by remelting.

Figure 3E:
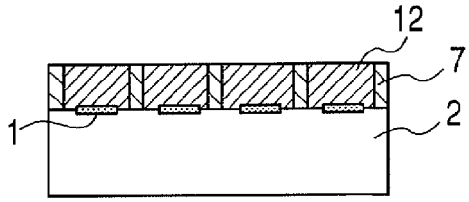

Subsequently, as shown in FIG. 3E, the sacrifice layer 12 is subjected to chemical mechanical polishing (CMP) from an upper surface of the sacrifice layer 12. This step is performed so that the surface of a member to be polished is polished and formed into a flattened surface parallel to the substrate. A technology already known as CMP processing is applicable to this step. The upper surface of the sacrifice layer 12 is physically polished by a polishing material. Moreover, a solvent is applied to the surface to chemically polish the surface. When this step is performed and an upper layer is laminated later on the polished surface, the upper layer is precisely flattened and laminated.

When the sacrifice layer is continuously polished, the polished surface reaches the first flow path forming member 7. When the polishing reaches the first flow path forming member 7, a material constituting the first flow path forming member 7 has a physical property different from that of a material constituting the sacrifice layer 12. Therefore, a polishing end point is detected owing to a change of the energy required for the polishing (e.g., a rise of torque). Moreover, a polishing speed drops. Through this step, the first flow path forming member 7 and the sacrifice layer 12 share the flattened surface, and a distance of the first flow path forming member from the substrate 2 is equal to that of the sacrifice layer from the substrate. For example, the cured material of the epoxy resin for general use has an elasticity module of about 2 to 4 GPa, whereas an elasticity module of the cured material of the resin composition (1) increases to about 7 Gpa, depending on the composition. Owing to the difference between the physical values, the end point of the polishing can easily be detected. It is considered that this elasticity module is brought because the inorganic fine particles (d) are contained. Therefore, excessive polishing can be prevented, and a height of the first flow path forming member 7 from the substrate can be controlled precisely.

Figure 3F:
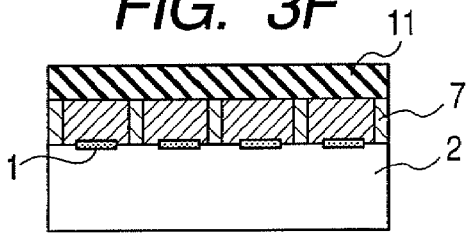

Subsequently, as shown in FIG. 3F, a photosensitive resin layer which forms the second flow path forming member 8 is disposed on the flattened flow path forming member and the sacrifice layer.

Figure 3G:
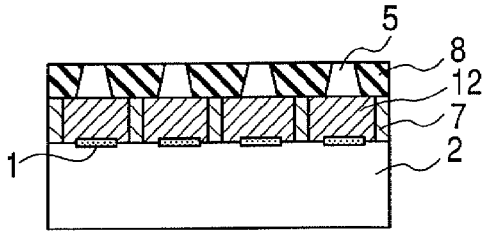

Subsequently, as shown in FIG. 3G, the second flow path forming member 8 is subjected to a photolithography step to form the discharge ports 5. Since the surface formed on the second flow path forming member 8 is flattened in the above-mentioned step, flatness is improved, and precisions of dimensions and shapes of the discharge ports 5 are improved.

Figure 3H:
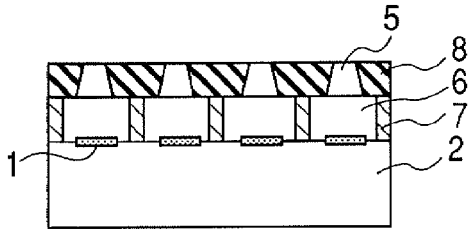

Finally, as shown in FIG. 3H, the sacrifice layer 12 is removed using a solvent or the like to form the flow paths 6 and the discharge ports 5.

Moreover, during or after the above-mentioned manufacturing steps, if necessary, the ink supply opening 3 may appropriately be formed on a substrate side. To form the ink supply opening 3, a known method such as anisotropic etching or dry etching may be used.

Furthermore, the present invention is not limited to the above-mentioned method. Needless to say, the materials described in the embodiment of the present invention are applicable to the method of manufacturing various ink jet recording heads.

The present invention will hereinafter be described in detail in accordance with examples.

Synthesis Example 1

Preparation of Solution 1 of Inorganic Fine Particles

A hydrolytic condensate 1 was synthesized according to the following procedure. After 12.51 g (0.045 mol) of glycidyl propyl triethoxysilane, 13.2 g (0.055 mol) of phenyl triethoxysilane, 218.4 g of colloidal silica (PL-1 manufactured by FUSO Chemical Co., Ltd. (13 wt % of a solid content)) and 2.7 g of water were stirred by use of hydrochloric acid as a catalyst at room temperature, these materials were heated and reflexed for 24 hours to obtain a hydrolytic condensate solution.

Reference Example 1

After a solvent was appropriately removed from a resin composition prepared as shown in Table 1 so as to obtain an appropriate concentration of a solid content, a negatively photosensitive resin layer was formed on a silicon substrate by spin coating, and pre-baked at 90° C. for four minutes. It is to be noted that a film thickness was 20 μm.

TABLE 1

| | | |
|---|---|---|
| Inorganic fine particle solution | Inorganic fine particle solution of Synthesis Example 1 | 247 parts by weight |
| Epoxy resin and cationic photopolymerization initiator | SU-8 2015 manufactured by KAYAKU Micro Chemical Co., Ltd. | 23.7 parts by weight |

Subsequently, the whole surface of the photosensitive resin layer was exposed using a mask aligner "MPA 600 super" manufactured by Canon Inc. Finally, to completely cure the photosensitive resin layer, the layer was superheated at 200° C. for one hour.

A linear expansion coefficient of the cured material of the resin composition prepared by the above step in a film thickness direction was obtained using a laser thermal expansion meter (LIX-1 manufactured by ULVAC, Inc.) in a measurement range of room temperature to 200° C.

Comparative Reference Example 1

A cured material was prepared in the same manner as in Reference Example 1 except that an inorganic fine particle solution was removed from Reference Example 1 and that SU-82015 manufactured by KAYAKU Micro Chemical Co., Ltd was used. A linear expansion coefficient of a cured resin material was obtained in the same manner as in Reference Example 1.

Comparative Reference Example 2

A cured material was prepared in the same manner as in Reference Example 1 except that a resin composition was prepared as shown in Table 2 by use of colloidal silica (PL-1 manufactured by FUSO Chemical Co., Ltd. (13 wt % of a solid content)) instead of the inorganic fine particle solution of Reference Example 1.

TABLE 2

| | | |
|---|---|---|
| Inorganic fine particle solution | Colloidal silica (PL-1 manufactured by FUSO Chemical Co., Ltd.) | 218.4 parts by weight |
| Epoxy resin and cationic photopolymerization initiator | SU-8 2015 manufactured by KAYAKU Micro Chemical Co., Ltd. | 23.7 parts by weight |

However, white turbidity was generated in a coating film, and a uniform and transparent coating film was not obtained.

The linear expansion coefficients of the cured materials of the resin compositions of Reference Example 1 and Comparative Reference Example 1 are shown in Table 3.

TABLE 3

| | Linear expansion coefficient (ppm/ |
|---|---|
| Reference Example 1 | 30 |
| Comparative Reference Example 1 | 61 |

Moreover, when the cured material of the resin composition of Reference Example 1 was formed on the substrate and an elasticity module of the material was measured using Fischer Scope H-100 manufactured by Fischer Instruments Ltd, the elasticity module was 7.7 GPa.

Example 1

In the present example, an ink jet recording head was prepared according to a procedure shown in FIGS. 2A to 2F.

First, a silicon substrate 2 provided with electrothermal transducing elements as energy generating elements 1 was coated with the resin composition of Reference Example 1 by use of a spin coating process (FIG. 2B).

Subsequently, the resin composition was pre-baked at 90° C. for ten minutes, and then exposed to a pattern to form flow paths 6 using a mask aligner "MPA 600 super" manufactured by Canon Inc. (FIG. 2C).

Subsequently, the silicon substrate 2 was heated at 90° C. for four minutes, developed with methyl isobutyl ketone (MIBK) and rinsed with isopropyl alcohol to form a first flow path forming member 7 (FIG. 2D). It is to be noted that a film thickness of the flow path forming member 7 after developed was 13 μm.

Subsequently, the substrate provided with the first flow path forming member 7 was cleaned and dry-heated (80° C.). Subsequently, an orifice plate of nickel prepared by electrolytic plating was heated and laminated under pressure as a second flow path forming member 8 on the substrate having a mandrel of photoresist (FIG. 2E).

Subsequently, a mask for forming a supply opening 3 was appropriately arranged on a back surface of the substrate, and the supply opening 3 was formed by anisotropic etching of the silicon substrate 2 (FIG. 2F).

After ending the anisotropic etching, the first flow path forming member 7 was superheated at 200° C. for one hour to completely cure the member. Finally, an ink supply member was bonded to the supply opening 3 to complete the ink jet recording head (not shown).

Example 2

A second example of the present invention is an example of a method of manufacturing an ink jet recording head by laminating a photosensitive resin on a substrate. In the example, the surface on which a member provided with discharge ports is to be laminated is flattened in advance to improve precisions of heights of flow paths formed in subsequent steps and flatness of the surface provided with the discharge ports.

First, a silicon substrate 2 provided with electrothermal transducing elements as energy generating elements 1 was coated with the resin composition of Reference Example 1 by a spin coating process. In consequence, a first photosensitive resin layer 10 was formed. A film thickness was 14 μm (FIG. 3B).

Subsequently, the substrate was pre-baked at 90° C. for six minutes, and exposed to a pattern to form flow paths 6 using a mask aligner "MPA 600 super" manufactured by Canon Inc. Subsequently, the substrate was heated at 90° C. for four minutes, developed with methyl isobutyl ketone (MIBK) and rinsed with isopropyl alcohol so as to form a first flow path forming member 7 (FIG. 3C).

Next, the substrate was coated with polymethyl isopropenyl ketone (ODUR-1010 manufactured by Tokyo Ohka Kogyo Co., Ltd.) as a sacrifice layer 12 by a spin coating process. In consequence, a film was formed (FIG. 3D). It is to be noted that polymethyl isopropenyl ketone is a so-called positive resist which is soluble to an organic solvent, when irradiated with an UV ray and decomposed.

Subsequently, after the substrate was pre-baked at 120° C. for six minutes, the substrate was polished in a chemical mechanical polishing (CMP) step (FIG. 3E). The step was performed to form the surface which was common to the first flow path forming member 7 and the sacrifice layer 12. Concave and convex portions were eliminated from the surface so as to flatten the surface in parallel with the substrate 2.

Subsequently, the flattened first flow path forming member 7 and sacrifice layer 12 were coated with the resin composition of Reference Example 1 by the spin coating process (FIG. 3F).

Subsequently, the substrate was pre-baked at 90° C. for six minutes, and then exposed to a pattern of discharge ports 5 using the mask aligner "MPA 600 super" manufactured by Canon Inc. Subsequently, the substrate was developed with methyl isobutyl ketone (MIBK) and rinsed with isopropyl alcohol. In consequence, the ink discharge ports 5 were formed (FIG. 3G).

Subsequently, a mask for forming a supply opening 3 was appropriately disposed on a back surface of the substrate 2, and the supply opening 3 was formed by anisotropic etching of the silicon substrate 2 (not shown). During the anisotropic etching of silicon, the surface of the substrate provided with a nozzle was protected with a rubber-based protective film. After ending the anisotropic etching, the rubber-based protective film was removed, the whole surface was again irradiated with the UV ray by use of a mask aligner UX3000 manufactured by Ushio Inc., and the sacrifice layer 12 was decomposed. Subsequently, while applying an ultrasonic wave to the substrate 2, the substrate was immersed into methyl lactate for one hour, and the sacrifice layer 12 was molten and removed. Subsequently, the substrate was heated for one hour in order to completely cure the first flow path forming member 7 and a second flow path forming member 8 (FIG. 3G).

As described above, the ink jet recording head was completed.

In the above-mentioned manufacturing method, since a cured material of a resin composition having a high elasticity module is used in the first flow path forming member 7, an end point of the polishing can easily be detected during the polishing.

Moreover, the ink jet recording head obtained by the example was evaluated as follows in order to evaluate characteristics concerning reliability.

<Printing Quality Level Evaluation>

When the ink jet recording heads obtained by Examples 1, 2 were filled with black ink BCI-9Bk manufactured by Canon Inc. to perform printing, the resultant image had a high quality level.

<Close Contact Property Evaluation>

When the ink jet recording heads obtained by Examples 1, 2 were immersed into ink BCI-6C (pH=about 9) manufactured by Canon Inc., a pressure cooker test (PCT) was performed (at 121° C. for 100 hours) and a close contact situation of a nozzle constituting member was observed, any change was not seen.

<Storage Property Evaluation>

When the ink jet recording heads obtained by Examples 1, 2 were filled with black ink BCI-9Bk manufactured by Canon Inc. and stored at 60° C. for two months and printing was then performed again, a printed matter similar to that before the storage test could be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-195145, filed Jul. 18, 2006, which is hereby incorporated by reference herein in its entirety.

What is claimed is:

1. A liquid discharge head comprising:

an energy generating element which generates energy for discharging a liquid;

a discharge port which discharges the liquid; and a flow path forming member to form a flow path which supplies the liquid to the discharge port, the flow path forming member being formed of a cured material of a resin composition including:

a cationic polymerizable resin, a cationic photopolymerization initiator, a condensation product of hydrolyzable organic silane compounds, and inorganic fine particles having an average particle diameter of 50 nm or less.

2. The liquid discharge head according to claim 1, wherein the flow path forming member includes a first flow path forming member formed on a substrate, and a second flow path forming member formed on the first flow path forming member; and at least the first flow path forming member is formed of the cured material of the resin composition.

3. The liquid discharge head according to claim 1, wherein the discharge port is arranged so as to face the energy generating element.

4. The liquid discharge head according to claim 1, wherein the cationic polymerizable resin is an epoxy resin.

5. A method of manufacturing a liquid discharge head including an energy generating element which generates energy for discharging a liquid, a discharge port which discharges the liquid, and a flow path which supplies the liquid to the discharge port, the method comprising:

forming a first photosensitive resin layer on a substrate, the first photosensitive resin layer including:

a cationic polymerizable resin, a cationic photopolymerization initiator, a condensation product of hydrolyzable organic silane compounds, and inorganic fine particles having an average particle diameter of 50 nm or less;

patterning the first photosensitive resin layer to form a flow path forming member which forms the flow path;

forming a sacrifice layer made of a soluble resin on the substrate so as to cover the flow path forming member;

polishing the sacrifice layer and the flow path forming member toward the substrate from a side of the substrate provided with the sacrifice layer to flatten the flow path forming member and the sacrifice layer;

forming a second photosensitive resin layer on the sacrifice layer and the flow path forming member;

patterning the second photosensitive resin layer to form the discharge port in the second photosensitive resin layer; and removing the sacrifice layer to form the flow path.

6. The method of manufacturing the liquid discharge head according to claim 5, wherein the polishing is carried out while a solvent is applied to the sacrifice layer and the flow path forming member.

7. The method of manufacturing the liquid discharge head according to claim 5, wherein a composition constituting the first photosensitive resin layer is prepared by the following:

mixing a plurality of hydrolyzable organic silane compounds with the inorganic fine particles having an average particle diameter of 50 nm or less;

obtaining a condensation product of hydrolyzable organic silane compound by condensing the hydrolyzable organic silane compounds with each other; and mixing a mixed product of the condensation product of the hydrolyzable organic silane compounds and the inorganic fine particles, a cationic polymerizable resin, and a cationic photopolymerization initiator.

* * * * *